US010018081B2

(12) United States Patent
Dopke et al.

(10) Patent No.: US 10,018,081 B2
(45) Date of Patent: Jul. 10, 2018

(54) ENGINE CYLINDER HEAD PUSH ROD TUBE CONFIGURATION

(71) Applicant: Champion Engine Technology, LLC, Sussex, WI (US)

(72) Inventors: Russell J. Dopke, Elkhart Lake, WI (US); Aleko D. Sotiriades, Cedarburg, WI (US); Mark J. Sarder, Waukesha, WI (US)

(73) Assignee: Champion Engine Technology, LLC, Sussex, WI (US)

( * ) Notice: Subject to any disclaimer, the term of this patent is extended or adjusted under 35 U.S.C. 154(b) by 485 days.

(21) Appl. No.: 14/270,699

(22) Filed: May 6, 2014

(65) Prior Publication Data

US 2015/0322882 A1 Nov. 12, 2015

(51) Int. Cl.

| | |
|---|---|
| ***F01P 7/00*** | (2006.01) |
| ***F01L 1/18*** | (2006.01) |
| ***F02F 1/32*** | (2006.01) |
| ***F01L 1/14*** | (2006.01) |
| *F02F 1/24* | (2006.01) |

(52) U.S. Cl.

CPC ..... *F01L 1/18* (2013.01); *F01L 1/146* (2013.01); *F02F 1/32* (2013.01); *F02F 1/24* (2013.01)

(58) Field of Classification Search

CPC .... F01L 1/146; F01L 1/245; F01L 1/14; F02F 1/30

USPC ..... 123/41.58, 90.31, 90.33, 90.55, 90.61

See application file for complete search history.

(56) References Cited

U.S. PATENT DOCUMENTS

| | | | | | |
|---|---|---|---|---|---|
| 2,700,377 | A | | 1/1955 | Chesnutt | |
| 2,963,012 | A | * | 12/1960 | Kolbe | F01M 9/10 123/90.33 |
| 3,200,801 | A | * | 8/1965 | Dornbos | 123/90.51 |
| 4,156,409 | A | * | 5/1979 | Nakano | 123/41.65 |
| 4,392,464 | A | * | 7/1983 | Woodward et al. | 123/196 R |
| 4,601,267 | A | * | 7/1986 | Kronich | F01M 11/02 123/41.86 |
| 4,762,098 | A | * | 8/1988 | Tamba | F01L 1/06 123/90.33 |
| 4,926,805 | A | * | 5/1990 | Tomlinson | 123/90.61 |
| 5,058,542 | A | * | 10/1991 | Grayson | F01M 13/0011 123/193.5 |
| 5,176,116 | A | * | 1/1993 | Lmagawa | F01L 1/14 123/196 M |

(Continued)

OTHER PUBLICATIONS

Honda GXV630, GXV660, GXV690 Engine Assembly Information, Honda Motor Co., Ltd., 2010.

*Primary Examiner* — Marguerite McMahon
*Assistant Examiner* — James Kim
(74) *Attorney, Agent, or Firm* — Ziolkowski Patent Solutions Group, SC

(57) ABSTRACT

A cylinder head and push rod tube configuration for an internal combustion engine is disclosed. The cylinder head includes a first end comprising a recessed rocker arm cavity. The cylinder head also includes a second end opposite the first end and defining an upper end of a combustion chamber. The recessed rocker arm cavity has a lower surface with a pair of push rod tube bores therethrough. The second end of the cylinder head has a pair of push rod tubes positioned in the push rod tube bores between the recessed rocker arm cavity and the second end. An intake port and an exhaust port each extend through the cylinder head to the combustion chamber.

23 Claims, 10 Drawing Sheets

(56) References Cited

U.S. PATENT DOCUMENTS

| | | | | |
|---|---|---|---|---|
| 5,421,292 | A * | 6/1995 | Hoffman | F02B 75/16 123/193.5 |
| 5,564,374 | A | 10/1996 | Hoffman et al. | |
| 6,047,678 | A * | 4/2000 | Kurihara | F01M 13/04 123/196 R |
| 6,216,659 | B1 | 4/2001 | Takegami et al. | |
| 6,739,304 | B2 | 5/2004 | Reinbold et al. | |
| 2009/0095261 | A1* | 4/2009 | Kono | F02B 75/045 123/48 B |
| 2013/0014721 | A1* | 1/2013 | Trease | F02F 1/4285 123/193.5 |
| 2013/0133597 | A1 | 5/2013 | Shimazaki et al. | |

* cited by examiner

ENGINE CYLINDER HEAD PUSH ROD TUBE CONFIGURATION

BACKGROUND OF THE INVENTION

Embodiments of the invention relate generally to overhead valve (OHV) engines utilizing push rod tubes, and more particularly, to an engine cylinder head and push rod tube configuration.

Overhead valve (OHV) engines use push rods to actuate valves in a cylinder head. The push rods are driven by a camshaft located in the engine block. The push rods actuate one end of a rocker arm which pivots on a trunnion pin or a rocker shaft located above the cylinder head. The other end of the rocker arm actuates an intake or exhaust valve. The rocker assembly is usually encased by a rocker cover.

In some engines, the push rods are contained in push rod tubes which protect the push rods and provide a path for oil to flow between the crankcase and rocker cover. Since push rods typically extend from the cylinder head to the block, when push rod tubes are utilized, they too extend from the cylinder head to the block. This results in requiring an affirmative seal to prevent oil seepage and contamination due to movement and differing expansion and contraction rates. The push rod tubes are therefore either threaded at both ends and screwed into the engine block and the head or the rocker cover, contain o-rings to provide an oil seal, and/or contain annular flanges and gaskets. Unfortunately, these components degrade over time and must be replaced and are time consuming to manufacture and install.

In air cooled internal combustion engines, it may be desirable to position push rod tubes and rocker covers to aid in transferring heat from the cylinder head and block. Air cooled internal combustion engines rely on cooling fins around the periphery of the cylinder block and head to increase surface area over which cooling air flows. However, push rod tubes may become effective cooling devices if they are positioned in the path of cooling air. Also, new enclosure designs for rocker components have the potential to increase surface area available for heat transfer. Rocker covers often act as insulators as they encapsulate the cylinder head, and therefore heat transfer from the cylinder head may be significantly improved with careful design.

Instead of push rod tubes, other engines use push rod passages formed within the cylinder head and block. While push rod passages do not require o-rings and gaskets, they require thicker walls within the cylinder head and block to provide room for the passages and require additional casting or machining steps. The thicker walls increase thermal resistance to heat transfer from the combustion chamber. Push rod tubes formed in the cylinder head also restrict air flow and reduce cooling capacity.

Therefore, it would be desirable to provide push rod tubes without components that degrade over time and that reduce manufacturing and assembly time. It would also be desirable for a cylinder head to have push rod tubes located in a position to maximize heat transfer to the ambient environment and are wholly contained within a single component of the engine. It would be further advantageous if a cylinder head had an enclosure for rocker components that increased heat transfer from the cylinder head.

BRIEF DESCRIPTION OF THE INVENTION

Embodiments of the invention relate to a cylinder head and push rod tube configuration for an internal combustion engine.

In accordance with one aspect of the invention, a cylinder head for an internal combustion engine includes a first end comprising a recessed rocker arm cavity. The cylinder head also includes a second end opposite the first end and defining an upper end of a combustion chamber. The recessed rocker arm cavity has a lower surface with a pair of push rod tube bores therethrough. The second end of the cylinder head has a pair of push rod tubes positioned in the push rod tube bores between the recessed rocker arm cavity and the second end. An intake port and an exhaust port each extend through the cylinder head to the combustion chamber.

In accordance with another aspect of the invention, a cylinder head assembly includes a cylinder head configured to be operatively coupled to a cylinder block. The cylinder head includes a base portion to contact the cylinder block, an intake port and an exhaust port, and a top portion comprising a recessed valve assembly cavity. The recessed valve assembly cavity and base portion form a gap therebetween along a side of the cylinder head. The cylinder head also includes a pair of push rod tubes extending through the gap from the base portion to the recessed valve assembly cavity. An intake valve and exhaust valve are in communication with the respective intake port and exhaust port. The intake valve and exhaust valve each have a stem extending into the recessed valve assembly cavity. A rocker arm assembly is coupled into the recessed valve assembly cavity. Each of a pair of push rods communicates with the rocker arm assembly and is inserted into a respective push rod tube.

In accordance with a further aspect of the invention, a multi-cylinder internal combustion engine includes a crankcase, a plurality of cylinders, and a plurality of cylinder heads. Each cylinder has a bore and a piston located in the bore. Each cylinder head has a lower end coupled to a respective cylinder and an upper end having a cavity for inclusion of rocker components. A recess is located under the cavity in the cylinder head within which a pair of push rod tubes are positioned and extend from the lower end to the cavity. The cylinder head further includes an intake valve in communication with an intake port and an exhaust valve in communication with an exhaust port, with the intake and exhaust valves each having stems protruding into the cavity. Rocker components are coupled to the inside of each cavity. A push rod is located in each of the push rod tubes and communicates with respective rocker components and the crankcase.

Various other features and advantages will be made apparent from the following detailed description and the drawings.

BRIEF DESCRIPTION OF THE DRAWINGS

The drawings illustrate embodiments presently contemplated for carrying out the invention.

In the drawings.

DETAILED DESCRIPTION

Embodiments of the invention are directed to an intake port of a cylinder head of an air cooled internal combustion engine; a push rod tube configuration within the cylinder head of the air cooled combustion engine; and an air guide for directing cooling air to the cylinder head of the air cooled combustion engine. The various embodiments of the invention are incorporated into the air cooled internal combustion engine, which in turn is incorporated as a prime mover/prime power source in any of a number of various applications, including but not limited to, power generators, lawnmowers, power washers, recreational vehicles, and boats, as just some examples. While embodiments of the invention are described below, it is to be understood that such disclosure is not meant to be limiting but set forth examples of implementation of the inventions. The scope of the inventions is meant to encompass various embodiments and any suitable application in which a general purpose internal combustion engine can benefit from the inventions shown and described herein. It is understood that certain aspects of the inventions may equally be applicable to non-air cooled internal combustion engines as well and such is within the scope of the present inventions.

Figure 1:
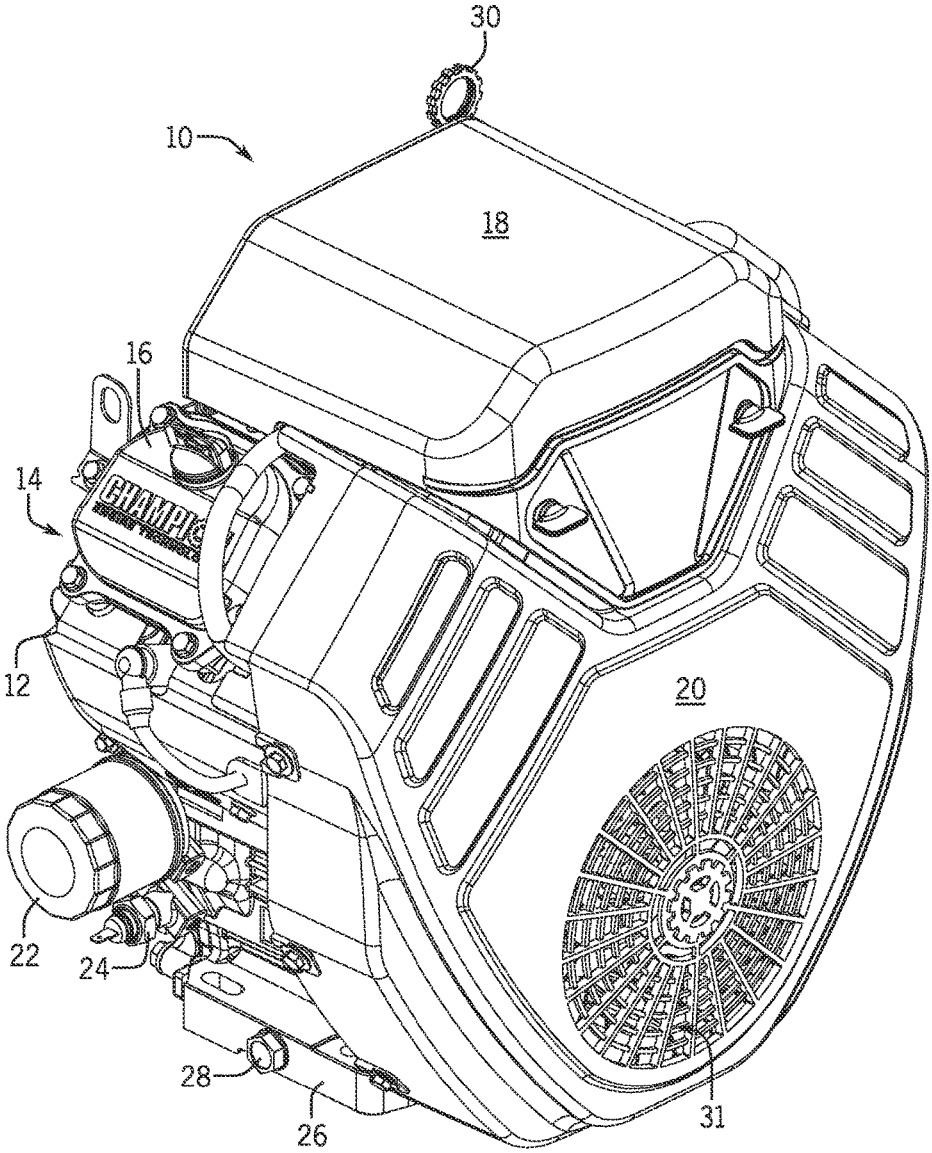
FIG. 1 is a perspective view of an internal combustion engine incorporating the present invention.

Referring first to FIG. 1, an internal combustion engine 10 is an exemplary V-twin having two combustion chambers and associated pistons (not shown) within an engine block 12 having a pair of cylinder heads 14 capped by rocker covers 16. The internal combustion engine 10 of FIG. 1 includes decorative and functional covers 18 and 20, as well as conventional oil filter 22, pressure sensor 24, oil pan 26, drain plug 28, and dip stick 30, together with the other conventional parts associated with an internal combustion engine. A cooling source 31 draws cooling air in toward internal combustion engine 10 through covers 20.

Figure 2:
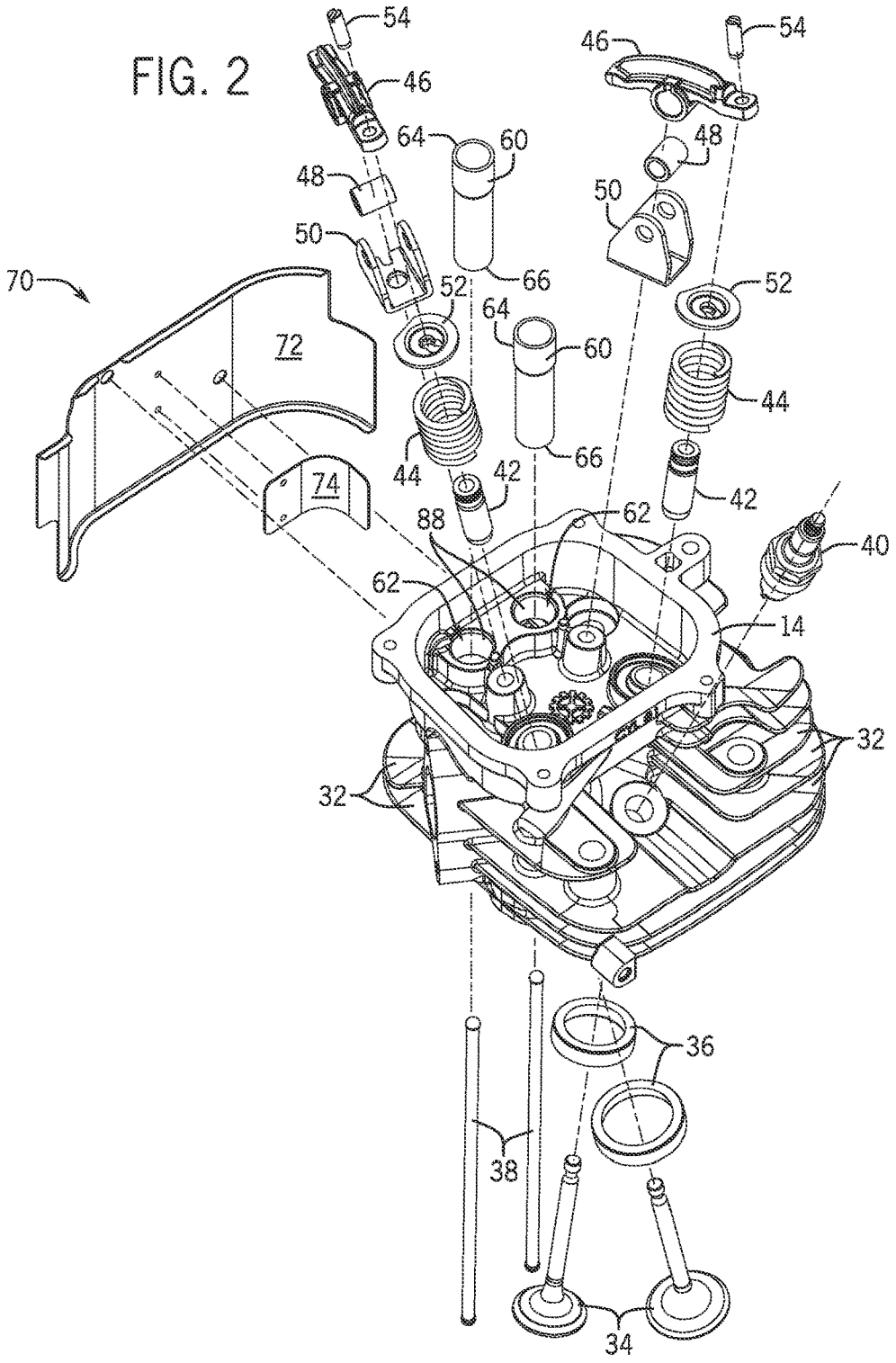
FIG. 2 is an exploded perspective view of a cylinder head of FIG. 1 incorporating the present invention.

FIG. 2 is an exploded view of cylinder head 14 having a plurality of cooling fins 32, intake and exhaust valves 34, valve seats 36, and push rods 38. Exploded from the upper portion of cylinder head 14 are spark plug 40, valve guides 42, valve springs 44, rocker arms 46, bushings 48, rocker arm supports 50, spring caps 52, and slack adjusters 54. All operational in a conventional manner.

Cylinder head 14 includes push rod tubes 60 that are pressed fit into respective bores 62 of cylinder head 14. Each push rod tube 60 has two outside diameters 64, 66 that are received into bore 62 of cylinder head 14 such that the smaller diameter 66 passes unobstructed through the bore 62 until the larger diameter 64 reaches the top of bore 62 to allow an even press-in fit. As is shown in further detail and will be described hereinafter with respect to FIGS. 9 and 10.

FIG. 2 also shows an air guide/diverter 70 having a main diverter shield 72 and a secondary air guide/diverter 74 attached thereto by fastening with anchors or welding. It is understood that the air guide/diverter 70 could be constructed as a single unitary structure or a multi-piece configuration having two or more pieces. The structure and function of the air diverter 70 will be further described with reference to FIGS. 11-14.

Figure 3:
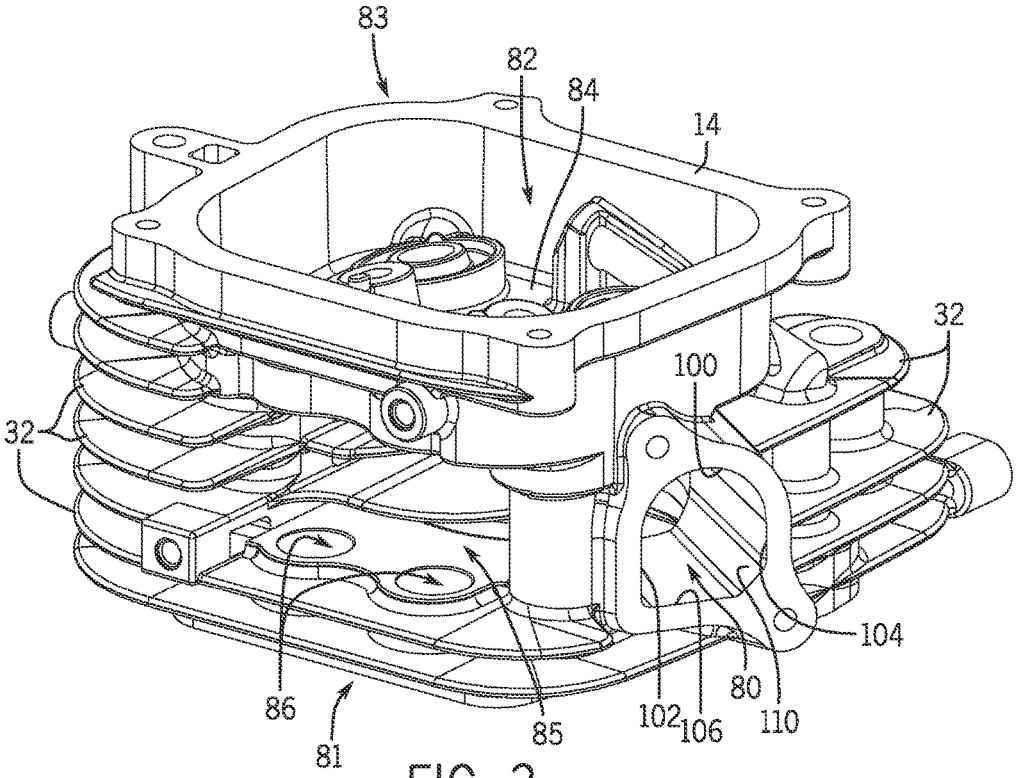
FIG. 3 is a side perspective view of the cylinder head of FIG. 2.
Figure 8:
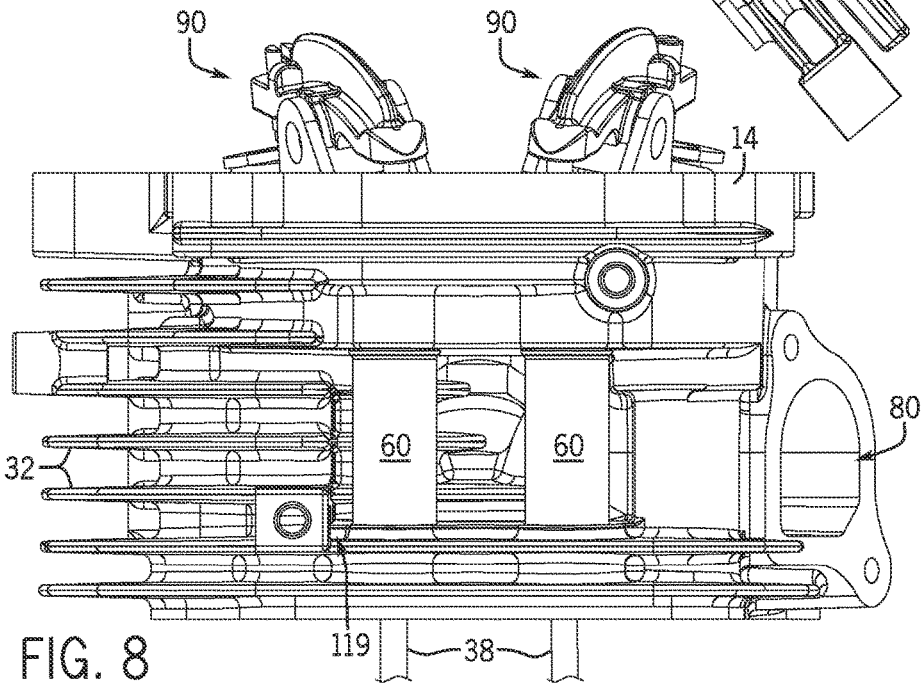
FIG. 8 is a side view of the cylinder head of FIG. 2 with rocker components assembled therein.

Referring next to FIG. 3, cylinder head 14 is shown with intake port 80 in the foreground. Cylinder head 14 has a base portion 81 to contact the cylinder block and a top portion 83 comprising a recessed rocker cavity 82. The recessed rocker cavity 82 and the base portion 81 may form a gap or recess 85 therebetween along a side of the cylinder head 14. The recessed rocker cavity 82 has a lower surface 84 and accommodates at least a portion of the valve springs 44 and the rocker arm assembly 90, as best shown in FIG. 8. Cylinder head 14 is then capped with rocker covers 16, as shown in FIG. 1. Referring back to FIG. 3, lower push rod tube bores 86 are shown having a smaller diameter than the upper push rod bores 88 as shown in FIG. 2 to accommodate the efficient press fit of push rod tubes 60 therein. Accordingly, as one skilled in the art will now recognize, the push rod tubes are wholly contained within the cylinder head from the lower surface 84 of the rocker cavity 82 down through push rod tube bores 86 extending near the lower surface of cylinder head 14, as will be described with reference to FIG. 9.

Figure 4:
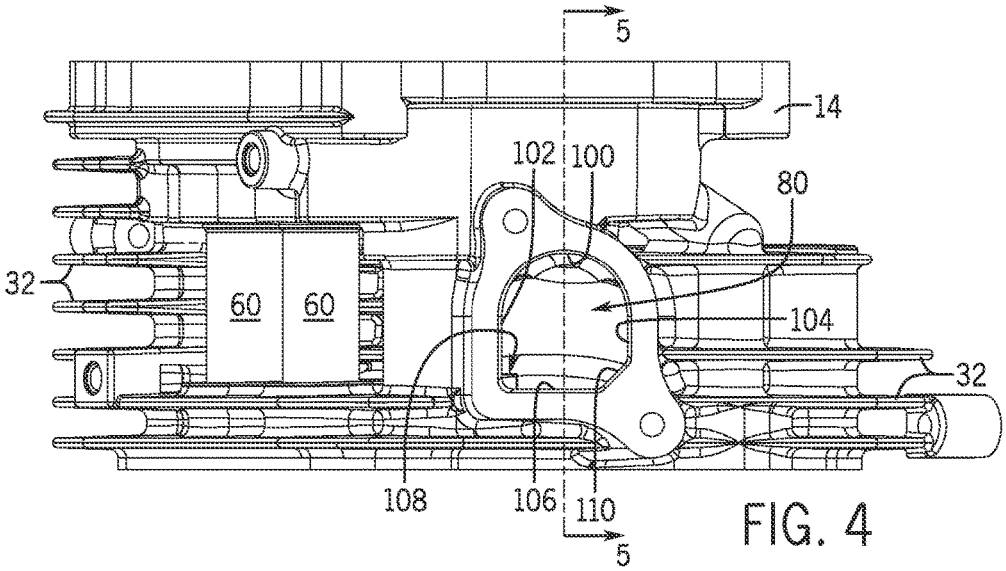
FIG. 4 is a side view of the cylinder head of FIG. 3.

Referring to both FIGS. 3 and 4, intake port 80 of cylinder head 14 is a modified D-shape that extends substantially evenly through cylinder head 14 toward the combustion chamber, other than the standard draft required for casting, which is typically and approximately 1°. The modified D-shape of intake port 80 comprises an arcuate surface 100 coupled to substantially flat side surfaces 102, 104 wherein flat side surface 102 extends a length greater than that of flat side surface 104. Flat side surface 106 is opposite arcuate surface 100 and is joined to flat side surface 102 by a generally right angle 108; however, it is understood that the inside corner of said right angle 108 may be formed by a gradual transition. Flat side surface 106 connects to flat side surface 104 via a flat, substantially planar, anti-puddling surface 110 in a general 45 degree angle, thereby cutting off, or eliminating, what would be the other 90 degree angle of a typical "D-shaped" configuration, thus forming the modified D-shaped configuration. The utility of the modified D-shaped configuration will be described with reference to FIG. 7.

Figure 5:
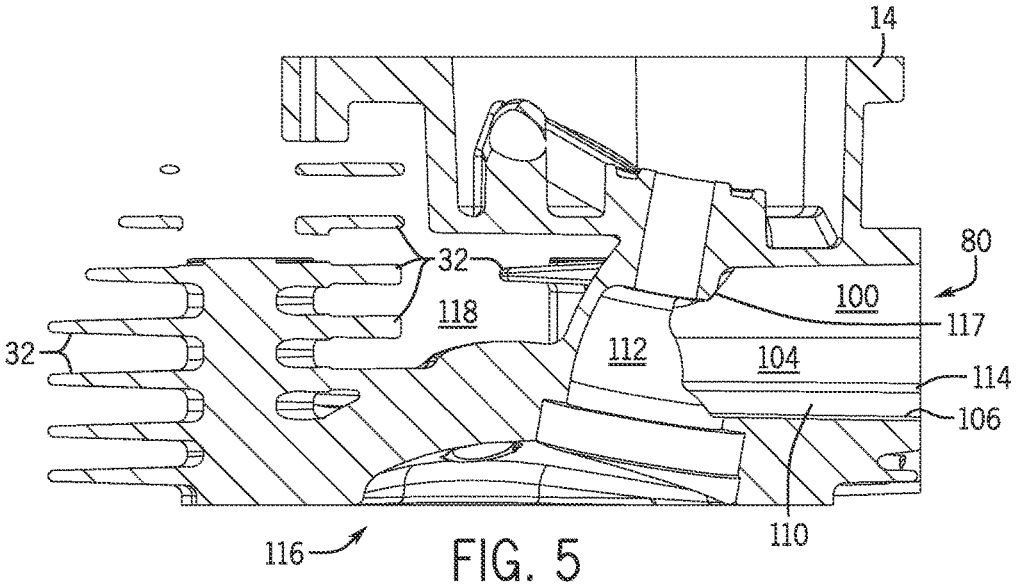
FIG. 5 is a cross-section view taken along line 5-5 of FIG. 4.

FIG. 5 is a cross-section taken along line 5-5 of FIG. 4 and shows intake port 80 of cylinder head 14 extending inward to intake valve passage 112. Intake port 80 is shown with the upper arcuate surface 100 connected to the flat side surface 104 connected to the anti-puddling surface 110 via a small transition surface 114. Intake valve passage 112 communicates with a combustion chamber 116. Intake port 80 extends substantially uniformly from an outer edge of cylinder head 14 to intersect with intake valve passage 112 and combustion chamber 116 at an inward transition region 117. The flat side surface 106 is substantially planar and its cross-section is perpendicular to a central axis of a cylinder bore and piston under the combustion chamber 116 or, in preferred embodiment, parallel to the bottom surface of the cylinder head. FIG. 5 also shows a cooling air pass-through 118 that provides additional cooling to cooling fins 32.

Figure 6:
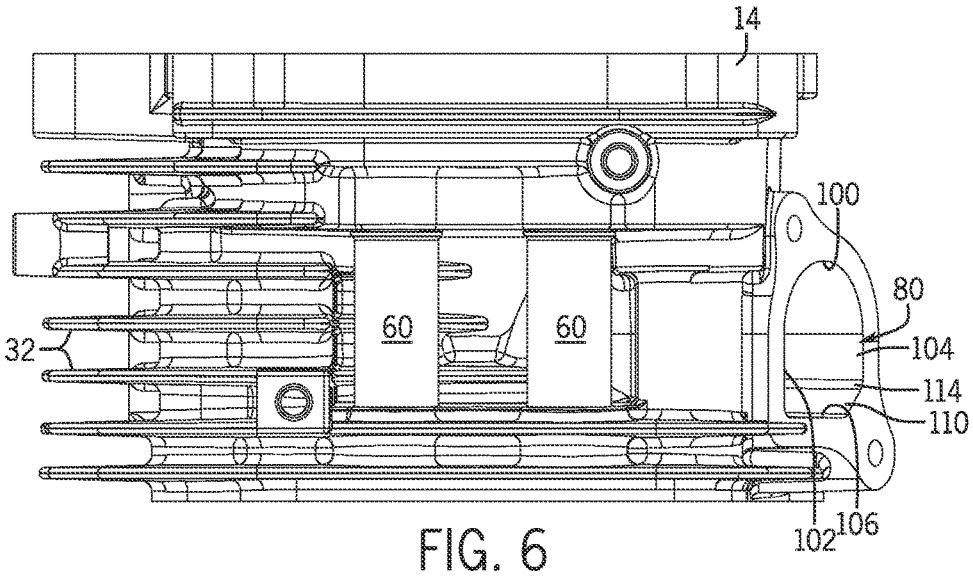
FIG. 6 is a side view of the cylinder head of FIG. 2.

Referring to FIG. 6, cylinder head 14 is shown in a side view having push rod tubes 60 inserted therein and shows another view of intake port 80 in perspective in which arcuate surface 100 connects to the substantially parallel flat side surfaces 102, 104, wherein flat side surface 104 connects to flat side surface 106 at a substantially right angle. The flat side surface 104 and the flat side surface 106 are connected by the flat, substantially planar, anti-puddling surface 110 via a transition surface 114.

Figure 7:
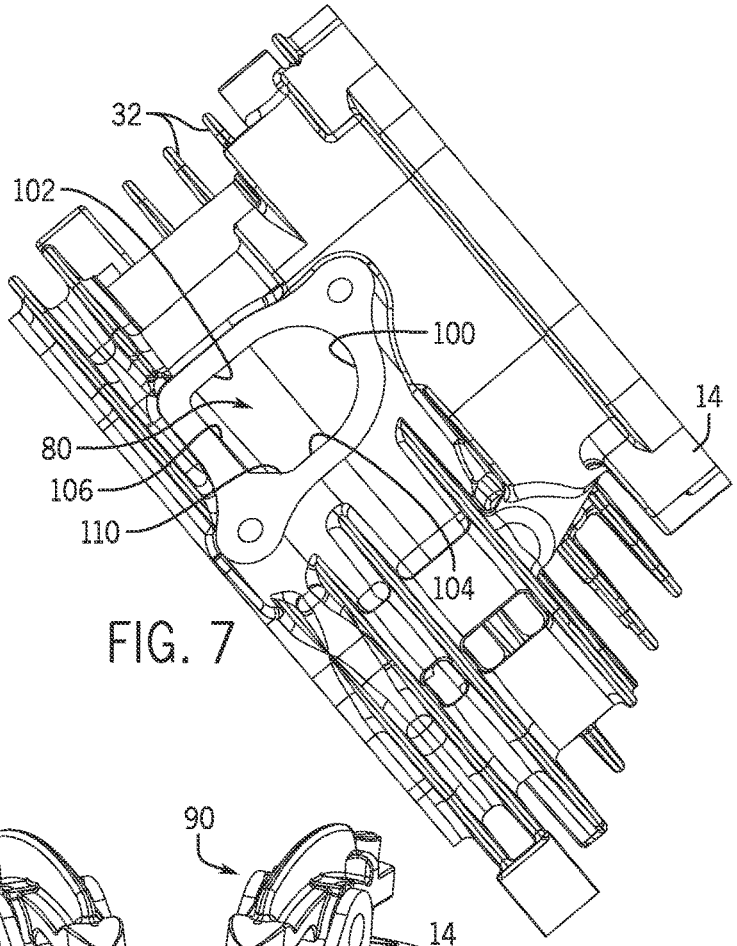
FIG. 7 is a side view of the cylinder head of FIG. 2 rotated in an exemplary orientation as implemented in the engine of FIG. 1.

FIG. 7 shows cylinder head 14 and intake port 80 orientated as installed on internal combustion engine 10 as shown in FIG. 1 in a horizontal crankshaft configuration such that the flat, substantially planar, anti-puddling surface 110 is substantially horizontal. In this configuration, the flat, anti-puddling surface 110 provides more surface area for unburned fuel to dissipate and prevent what is known in the industry as "puddling." As is known, "puddling" of fuel in a liquid form can cause a pop or backfiring on re-ignition. The anti-puddling surface 110, in the horizontal crankshaft orientation, reduces the occurrence of such puddling in a properly tuned engine. The aforementioned internal combustion engine 10 of FIG. 1 is also constructed to operate in a vertical crankshaft position wherein flat side surface 102 is substantially parallel with the horizon and thus becomes the anti-puddling surface. Alternatively, one skilled in the art will now readily recognize that the other surfaces could be used in conjunction with one another to provide at least two anti-puddling surfaces in engine configuration orientations rotated in approximately 45 degree increments. Such configuration provides for a wide implementation of an engine incorporating the present invention. This increased surface area on the horizontal surface allows for the spreading out of fuel over a wider surface to promote higher evaporation rates, which in turn improves atomization to improve the combustion process, and results in reduced misfires and improves the consistency of the exhaust emissions. Additionally, the reduction and/or elimination of fuel puddling that is provided by the present invention also reduces any periodic over-rich combustion that typically results in black exhaust emission.

FIG. 8 shows cylinder head 14 assembled with rocker arm assemblies 90 mounted thereon and push rods 38 extending upward to the rocker arm assemblies 90 through push rod tubes 60. In an exemplary embodiment, cooling fins 32 extend outwards from cylinder head 14 with an interrupt 119 at the location of the push rod tubes 60. Also, intake port 80 is shown in a side perspective view. As previously mentioned, rocker covers 16 of FIG. 1 is attached over cylinder head 14 to enclose rocker arm assemblies 90.

Figure 9:
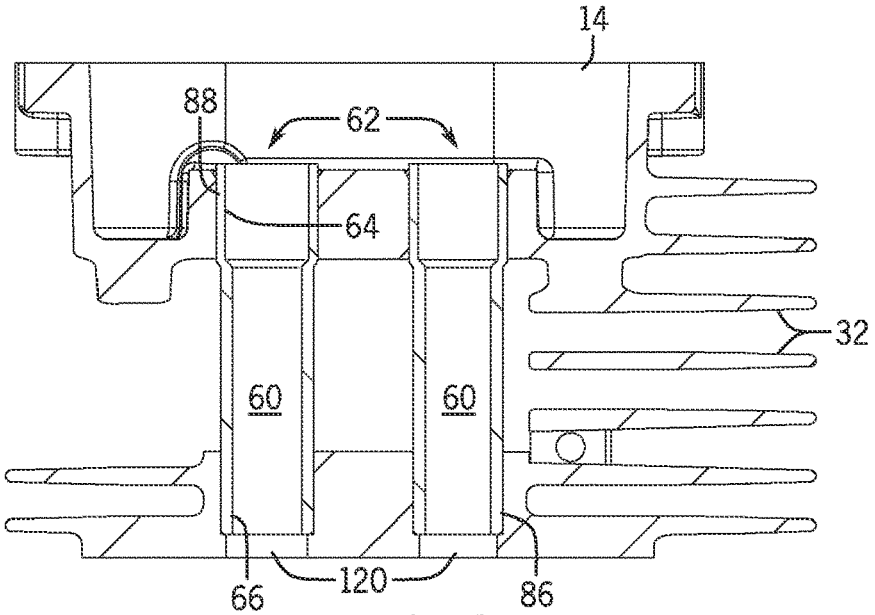
FIG. 9 is a sectional view of the cylinder head of FIG. 2 showing push rod tube holders in cross section.

Referring now to FIG. 9, cylinder head 14 is shown in cross section through push rod tubes 60. Push rod tubes 60 have a smaller diameter 66 on a lower end and a larger diameter 64 at an upper end. With the cylinder head 14 having a larger bore 88 at the upper end and a smaller bore 86 at the lower end to allow for push rod tubes 60 to be dropped into the passage bores 62 until resistance is met whereby the push rod tubes 60 are then pressed into place against boss stops 120. The boss stops provide affirmative seating of the push rod tubes 60 into cylinder head 14.

Figure 10:
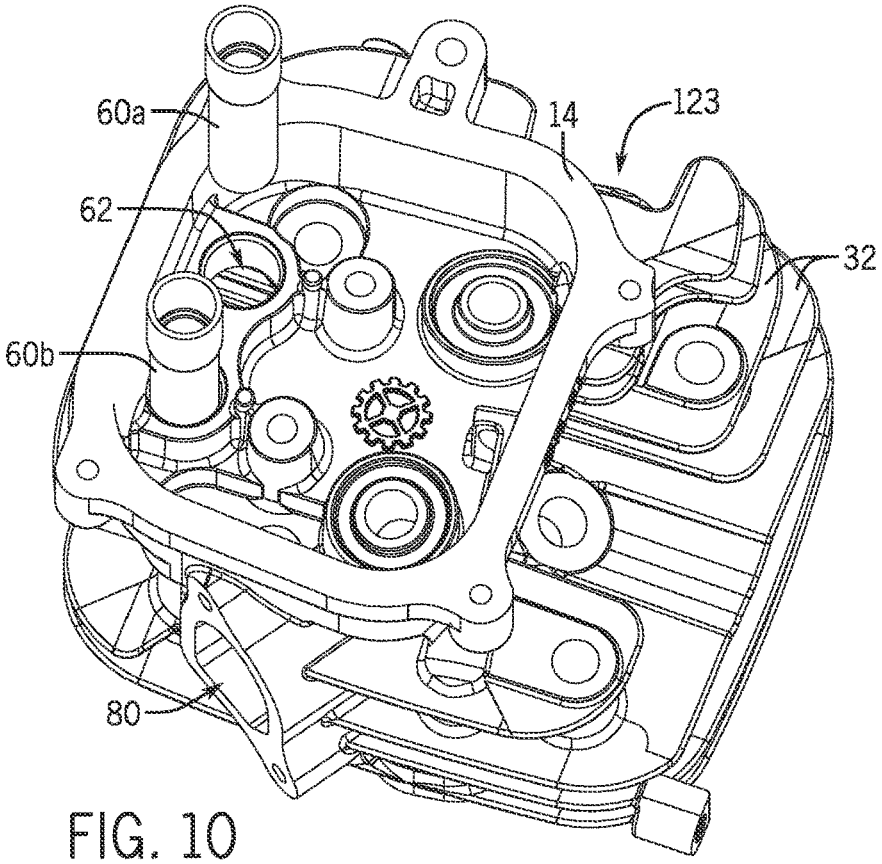
FIG. 10 is a top perspective view of the cylinder head of FIG. 2.

Referring to FIG. 10, cylinder head 14 is shown in perspective from a top side view with push rod tube 60(*a*) above push rod tube passage bores 62, and push rod tube 60(*b*) partially inserted into its respective passage to then be pressed firmly into place. The modified D-shaped intake port 80 is shown from the top side view perspective. An exhaust port 123 is shown on the opposite side of cylinder head 14 from intake port 80.

Figure 11:
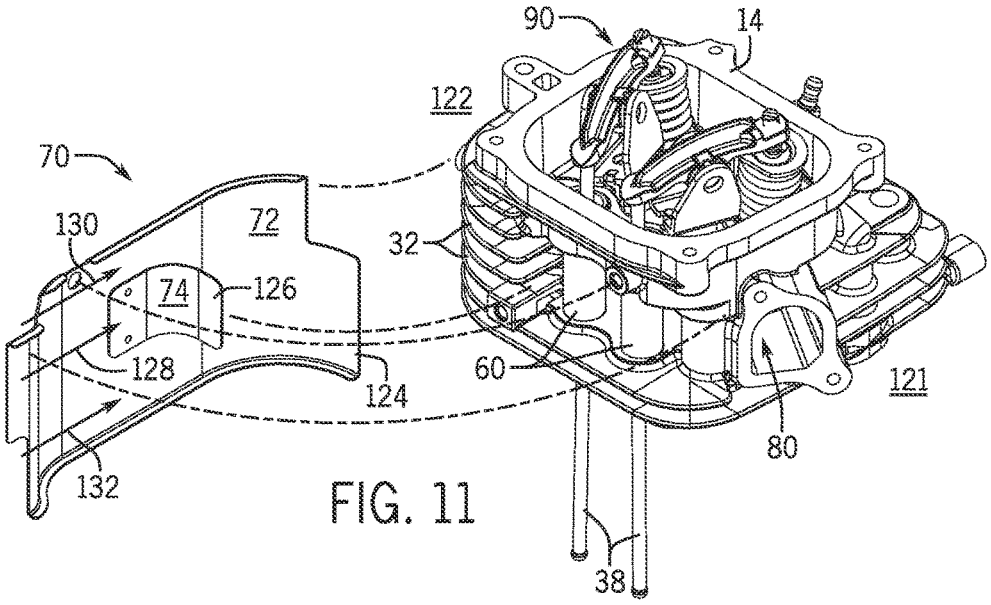
FIG. 11 is a perspective view showing an assembled cylinder head of FIG. 2 with an air guide rotated away therefrom.

FIG. 11 shows cylinder head 14 in an assembled configuration with rocker arm assemblies 90 installed therein and push rods 38 extending therefrom. Air diverter 70 is shown rotated away from cylinder head 14 where it is secured thereto. Air diverter 70 includes a main diverter shield 72 which extends from a cooling source at a front side 121 of the engine to a back side 122 of the engine. A cooling source 31, of FIG. 1, draws air inward through engine cover 20 and air diverter 70 directs some of that cooling air into and across at least two distinct areas of cylinder head 14. Main diverter shield 72 has a first arcuate member 124 to direct cooling air over and across cooling fins 32 at a back side 122 of cylinder head 14. The second arcuate member 126 directs air to and across push rod tubes 60 and cooling fins 32 behind the push rod tubes 60. The air flow is constructively divided into three paths, an internal air path shown by arrow 128 and directed by the secondary air guide/diverter 74 and second arcuate member 126, and rear air flow path 130,132 being directed by main diverter shield 72 and first arcuate member 124.

Figure 12:
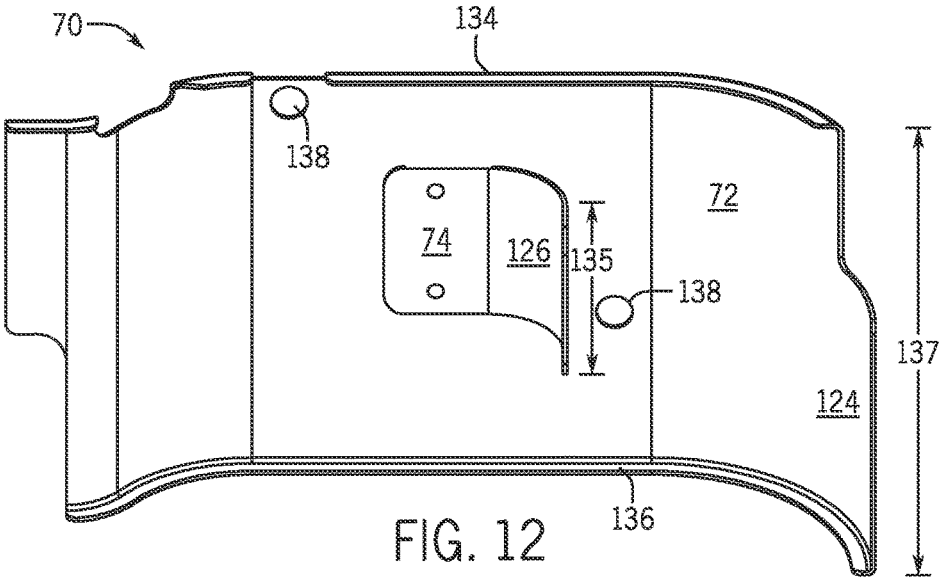
FIG. 12 is a side view of the air guide of FIG. 11.

Referring to FIG. 12, these air flow channels are formed by the second arcuate member 126 having a width 135 less than the width 137 of the first arcuate member 124. Air guide 70 is constructed with upper and lower lips 134, 136 to assist in retaining air flow within air guide 70. Openings 138 allow for fasteners to pass therethrough and fasten air guide 70 to cylinder head 14.

Figure 13:
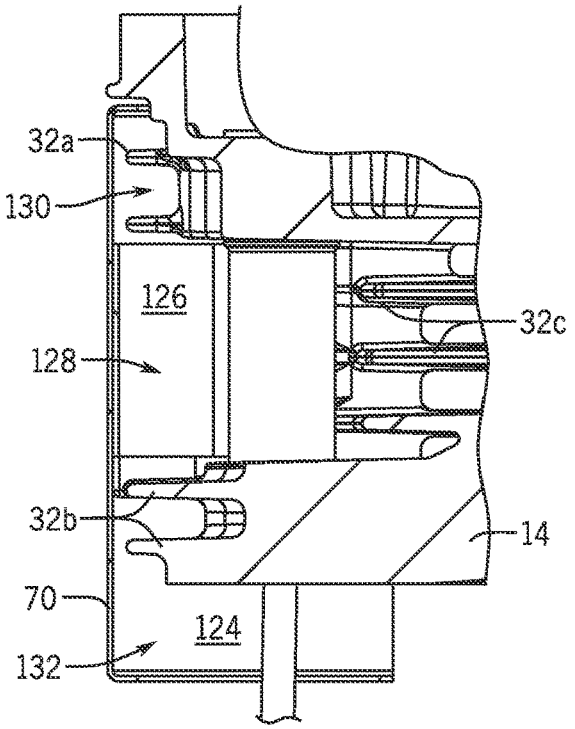
FIG. 13 is a partial sectional view of the cylinder head and air guide of FIG. 11.

FIG. 13 is a section view showing the multiple air path/channels 128, 130, 132. Air flow path 130 directs cooling air across cooling fins 32(*a*), while air flow path 132 directs air across cooling fins 32(*b*). The internal air flow path 128 directs air across cooling fins 32(*c*) located centrally and internally within cylinder head 14.

Figure 14:
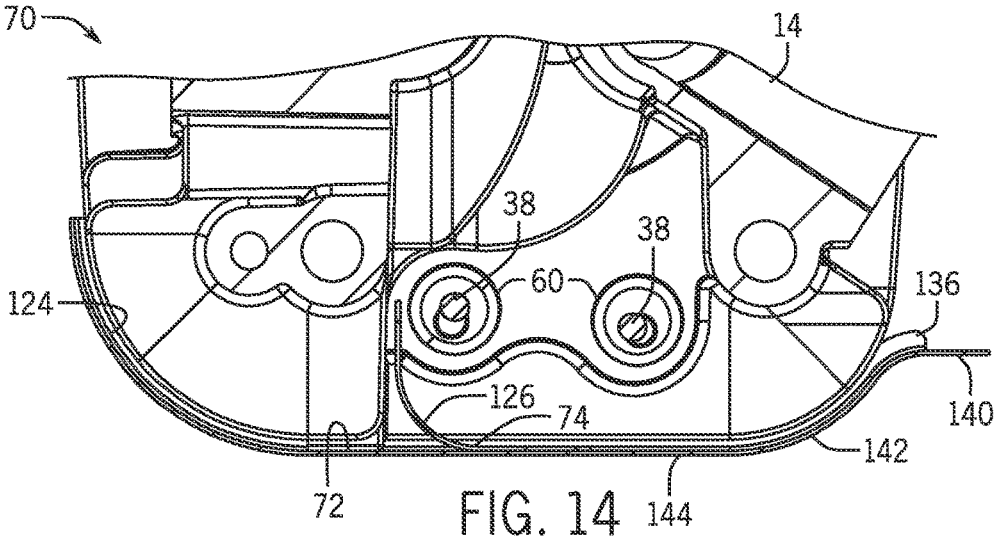
FIG. 14 is a partial top view of the cylinder head and air guide configuration of FIG. 11.

Referring to FIG. 14, is a top section view showing air diverter 70 from a top view installed on cylinder head 14. Air guide 70 includes a first planar section 140 extending frontward to receive air flow therein connected to transition section 142 leading to longitudinally planar section 144 and terminating at the first and second arcuate members 124, 126. FIG. 14 also shows push rod tubes 60 installed in cylinder head 14 with push rods 38 extending therethrough.

Figure 15:
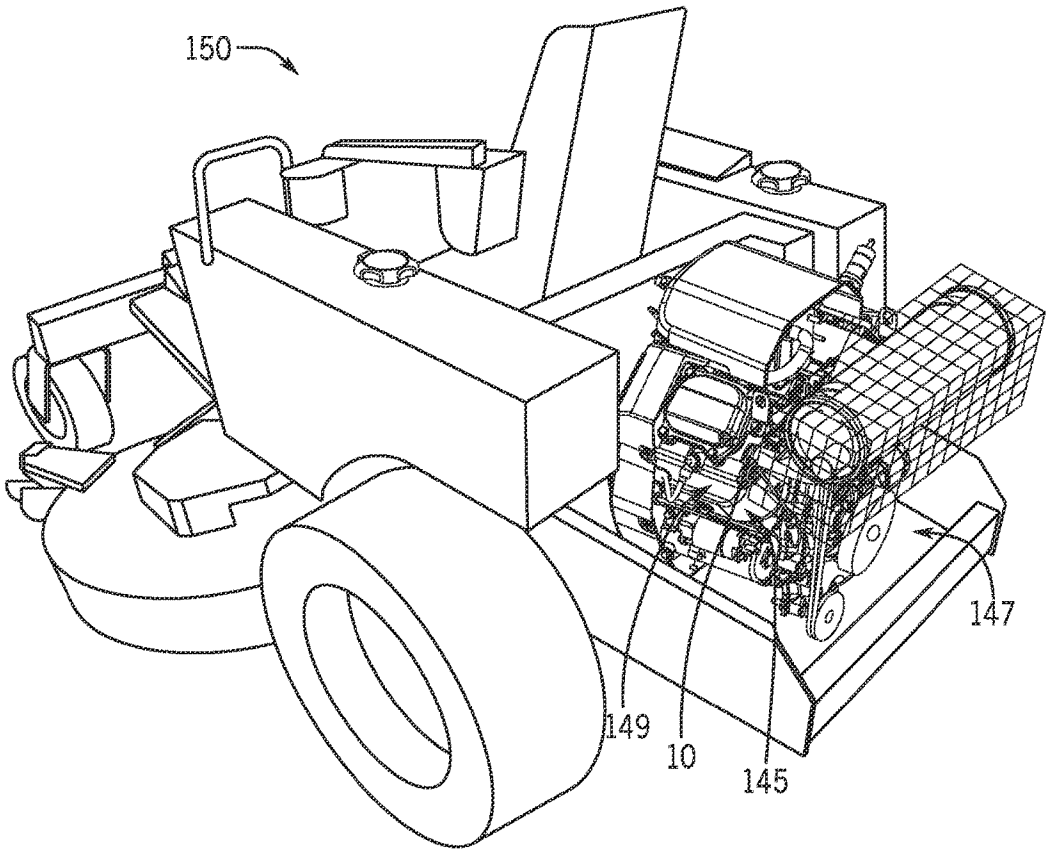
FIG. 15 is a perspective view of a wheel driven vehicle incorporating the present invention.

FIG. 15 shows an example of a wheel driven vehicle 150 powered by internal combustion engine 10 incorporating the present inventions. Internal combustion engine 10 is depicted in perspective from a top side view showing a cylinder block 145 coupled to a crankcase 147 and a cylinder head assembly 149 coupled to the cylinder block. In this case, the wheel driven vehicle is a lawnmower, but could equally be any wheel driven vehicle.

Figure 16:
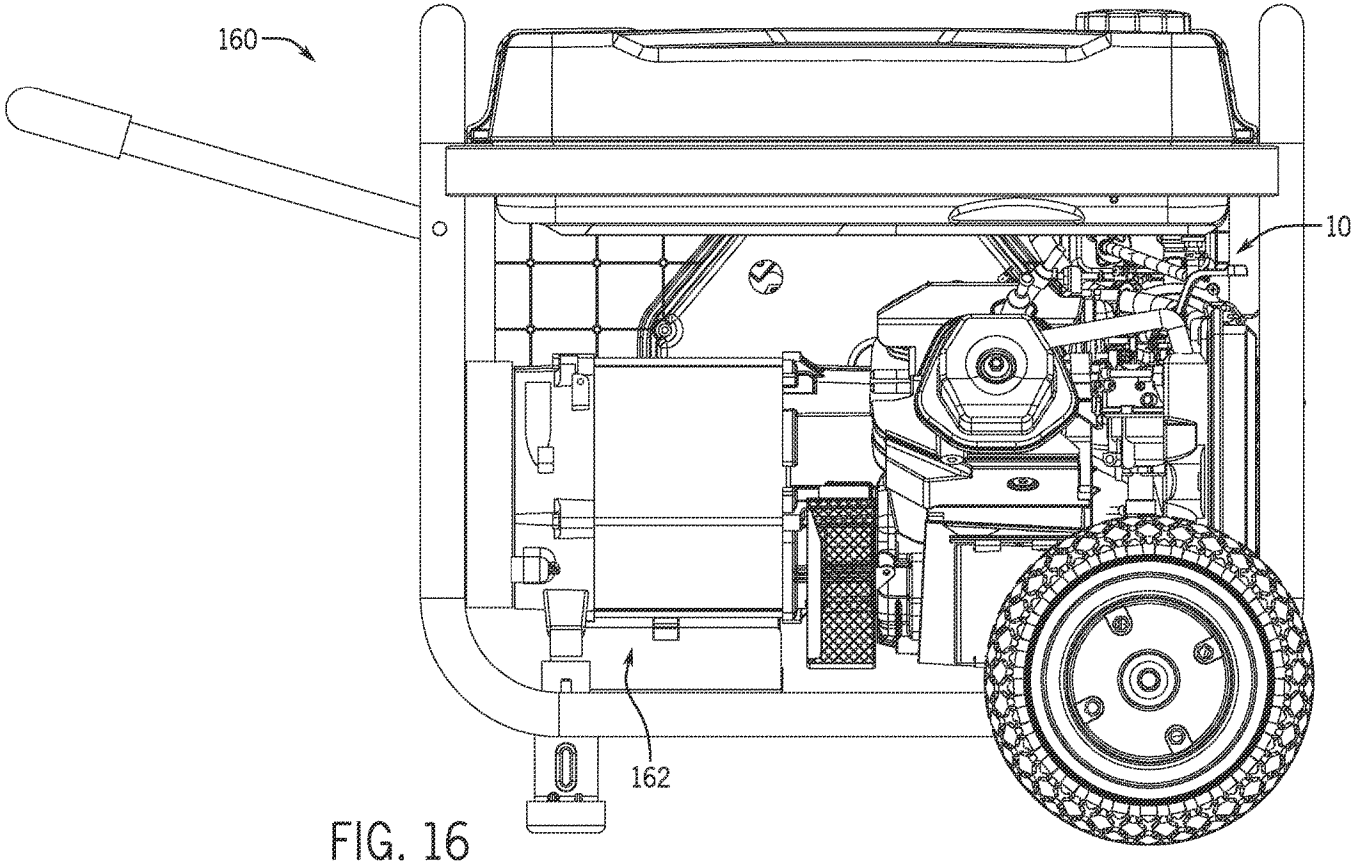
FIG. 16 is an exemplary non-wheel driven apparatus incorporating the present invention.

FIG. 16 shows a non-wheel driven apparatus 160, in this case a portable generator. The portable generator includes internal combustion engine 10 driving a generator unit 162 and is just one example of a non-wheel driven apparatus benefitting from the inventions described herein, but could equally be applicable to any non-wheel driven apparatus, including watercraft.

As one skilled in the art will now readily recognize, by eliminating push rod passages that are usually cast into the cylinder head, and minimizing the push rod tubes, a substantial amount of the casting can be eliminated resulting in new open areas that can be utilized for additional cooling. The new push rod tubes of the present invention allow for more cooling air to communicate with the combustion chamber and exhaust port.

Therefore, according to one embodiment of the invention, a cylinder head for an internal combustion engine includes a first end comprising a recessed rocker arm cavity. The cylinder head also includes a second end opposite the first end and defining an upper end of a combustion chamber. The recessed rocker arm cavity has a lower surface with a pair of push rod tube bores therethrough. The second end of the cylinder head has a pair of push rod tubes positioned in the push rod tube bores between the recessed rocker arm cavity and the second end. An intake port and an exhaust port each extend through the cylinder head to the combustion chamber.

According to another embodiment of the invention, a cylinder head assembly includes a cylinder head configured to be operatively coupled to a cylinder block. The cylinder head includes a base portion to contact the cylinder block, an intake port and an exhaust port, and a top portion comprising a recessed valve assembly cavity. The recessed valve assembly cavity and base portion form a gap therebetween along a side of the cylinder head. The cylinder head also includes a pair of push rod tubes extending through the gap from the base portion to the recessed valve assembly cavity. An intake valve and exhaust valve are in communication with the respective intake port and exhaust port. The intake valve and exhaust valve each have a stem extending into the recessed valve assembly cavity. A rocker arm assembly is coupled into the recessed valve assembly cavity. Each of a pair of push rods communicates with the rocker arm assembly and is inserted into a respective push rod tube.

According to yet another embodiment of the invention, a multi-cylinder internal combustion engine includes a crankcase, a plurality of cylinders, and a plurality of cylinder heads. Each cylinder has a bore and a piston located in the bore. Each cylinder head has a lower end coupled to a respective cylinder and an upper end having a cavity for inclusion of rocker components. A recess is located under the cavity in the cylinder head within which a pair of push rod tubes are positioned and extend from the lower end to the cavity. The cylinder head further includes an intake valve in communication with an intake port and an exhaust valve in communication with an exhaust port, with the intake and exhaust valves each having stems protruding into the cavity. Rocker components are coupled to the inside of each cavity. A push rod is located in each of the push rod tubes and communicates with respective rocker components and the crankcase.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A cylinder head for an internal combustion engine, the cylinder head comprising:

a first end comprising a recessed rocker arm cavity, the recessed rocker arm cavity having a lower surface with a pair of push rod tube bores therethrough;

a second end opposite the first end and defining an upper end of a combustion chamber, the second end having another pair of push rod tube bores therethrough;

a pair of push rod tubes positioned in the push rod tube bores between the recessed rocker arm cavity and the second end of the cylinder head; and an intake port and an exhaust port each extending through the cylinder head to the combustion chamber.

2. The cylinder head of claim 1 further comprising a pair of stops in the push rod tube bores at the second end of the cylinder head wherein the push rod tubes have a first end butted up to the stops and a second end coupled in the lower surface of the recessed rocker arm cavity.

3. The cylinder head of claim 1 wherein the set of push rod tube bores on the second end have a diameter less than a diameter of the push rod tube bores on lower surface of the recessed rocker arm cavity and the pair of push rod tubes each have a lower end diameter less than an upper end diameter.

4. The cylinder head of claim 3 wherein the push rod tubes are constructed to be press fit into the push rod tube bores formed in the lower surface of the rocker arm cavity.

5. The cylinder head of claim 1 wherein a mid-section of the push rod tubes are exposed.

6. The cylinder head of claim 1 further comprising cooling fins extending outward from the cylinder head and a cooling passage about the push rod tubes.

7. The cylinder head of claim 6 further comprising an air guide positioned to provide cooling air to the cooling fins and the cooling passage about the push rod tubes.

8. A cylinder head assembly, the assembly comprising:

a cylinder head configured to be operatively coupled to a cylinder block, the cylinder head comprising:

a base portion to contact the cylinder block;

an intake port and an exhaust port;

a top portion comprising a recessed valve assembly cavity, the recessed valve assembly cavity and base portion forming a gap therebetween along a side of the cylinder head; and a pair of push rod tubes extending through the gap from the base portion to the recessed valve assembly cavity;

an intake valve and exhaust valve in communication with the respective intake port and exhaust port, the intake valve and exhaust valve each having a stem extending into the recessed valve assembly cavity;

a rocker arm assembly coupled into the recessed valve assembly cavity; and a pair of push rods, each push rod inserted into a respective push rod tube and in communication with the rocker arm assembly.

9. The cylinder head assembly of claim 8 wherein each push rod tube has one end coupled to the base portion, and a second end coupled to a cavity floor of the recessed valve assembly cavity.

10. The cylinder head assembly of claim 9 wherein the cavity floor and the base portion each have a pair of openings formed therein adapted to receive a respective push rod tube.

11. The cylinder head assembly of claim 10 wherein the push rod tubes are press fit into the respective openings formed in the cavity floor and base portion.

12. The cylinder head assembly of claim 11 wherein each of the push rod tubes has an outer diameter at the first end different from an outer diameter at the second end.

13. The cylinder head assembly of claim 8 further comprising cooling fins extending outwards from the cylinder head and providing an interrupt at the location of the push rod tubes.

14. The cylinder head assembly of claim 9 further comprising an air guide mounted to the cylinder head and configured to provide cooling air toward the push rod tubes and a cooling passage therebehind.

15. The cylinder head assembly of claim 12 wherein the base portion includes a boss located in each of the openings formed therein to align the push rod tubes.

16. A multi-cylinder internal combustion engine, the engine comprising:

a crankcase;

a plurality of cylinders, each cylinder having a bore and a piston located in the bore;

a plurality of cylinder heads, each cylinder head having a lower end coupled to a respective cylinder, each cylinder head further comprising:

an upper end having a cavity for inclusion of rocker components;

a recess located under the cavity;

a pair of push rod tubes positioned within the recess and extending from the lower end to the cavity;

an intake valve in communication with an intake port, and an exhaust valve in communication with an exhaust port, the intake and exhaust valves each having stems protruding into the cavity;

rocker components coupled to the inside of each cavity;

a push rod located in each of the push rod tubes and in communication with respective rocker components and the crankcase.

17. The multi-cylinder internal combustion engine of claim 16 further comprising a plurality of air diverters, each air diverter coupled to a respective cylinder head.

18. The multi-cylinder internal combustion engine of claim 16 wherein the cavity and the lower end each have a plurality of openings formed therein to receive a pushrod tube, and further wherein each push rod tube is press fit into an opening in the lower end and an opening in the cavity.

19. The multi-cylinder internal combustion engine of claim 18 wherein each push rod tube has an outer diameter at the first end that is smaller than the outer diameter of the second end; and further wherein the openings formed in the lower end correspond to the outer diameter of the first end, and the openings formed in the cavity correspond to the outer diameter of the second end.

20. The multi-cylinder internal combustion engine of claim 16 wherein each cylinder head comprises cooling fins extending outwards therefrom, the cooling fins of each cylinder head provide an interrupt at a location of each push rod tube.

21. The multi-cylinder internal combustion engine of claim 16 incorporated into one of a wheel driven vehicle and a non-wheel driven apparatus.

22. The cylinder head assembly of claim 8 mounted on an engine in one of a wheel driven vehicle and a non-wheel driven apparatus.

23. The cylinder head of claim 1 mounted on an engine in one of a wheel driven vehicle and a non-wheel driven apparatus.

* * * * *